US007078608B2

(12) United States Patent
Aiso et al.

(10) Patent No.: US 7,078,608 B2
(45) Date of Patent: Jul. 18, 2006

(54) MIXING SYSTEM CONTROL METHOD, APPARATUS AND PROGRAM

(75) Inventors: Masaru Aiso, Hamamatsu (JP); Kotaro Terada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 110 days.

(21) Appl. No.: 10/774,013

(22) Filed: Feb. 6, 2004

(65) Prior Publication Data

US 2004/0159218 A1 Aug. 19, 2004

(30) Foreign Application Priority Data

Feb. 13, 2003 (JP) ..... 2003-034688
Feb. 13, 2003 (JP) ..... 2003-034706

(51) Int. Cl.
*G10H 7/00* (2006.01)

(52) U.S. Cl. ..... 84/625; 700/94; 381/119

(58) Field of Classification Search ..... 84/625, 84/615, 601; 700/94; 381/119, 109, 123; 379/202.01

See application file for complete search history.

(56) References Cited

U.S. PATENT DOCUMENTS 5,578,778 A 11/1996 Imaizumi
6,795,560 B1 * 9/2004 Hamamatsu ..... 381/119
2002/0156547 A1 * 10/2002 Suyama et al. ..... 700/94
2003/0059066 A1 * 3/2003 Kohyama et al. ..... 381/119
2004/0073419 A1 * 4/2004 Aoki et al. ..... 704/201
2004/0131209 A1 * 7/2004 Okabayashi ..... 381/119

OTHER PUBLICATIONS

Yamaha, DM 2000 Owner's Manual, Digital Production Console (Feb. 1, 2002).

* cited by examiner

*Primary Examiner*—Marlon T. Fletcher
*Assistant Examiner*—Christina Russell
(74) *Attorney, Agent, or Firm*—Morrison & Foerster LLP

(57) ABSTRACT

In order to set in advance, for each scene, setting data that should belong to (or should not belong to) a recall range, a predetermined recall setting window is displayed for a current data set representing current settings of a mixing system. Buttons in a parameter selection section correspond to parameters of each channels belonging to the current data set, and the buttons can turned on and off. When the current data set is to be recorded as a scene data set, settings of the recall setting window are also stored as part of the current data set. When the scene is to be recalled, only setting data of parameters, having been set as data belonging to the recall range, are recalled. Also, editing of a channel name is permitted in order to perform optimal name display for channel strips of the system in accordance with a form of use of the system.

12 Claims, 9 Drawing Sheets

MIXING SYSTEM CONTROL METHOD, APPARATUS AND PROGRAM

BACKGROUND OF THE INVENTION

The present invention relates to an improved control method, apparatus and computer program suitable for controlling mixing systems.

U.S. Pat. No. 5,578,778 discloses a technique for setting parameters for an electronic musical instrument, in accordance with which any change in parameters set by a human player is inhibited in a freeze setting mode. Generally, in mixing systems, parameter values in mixing algorithms are determined in accordance with ON/OFF states and other operating states of various buttons, faders and other operators. In recent years, of the mixing systems, particularly those intended for commercial use, there have been known ones which are constructed to store parameter values in memory so as to reproduce the thus-stored values (setting data) on an operation panel through one-touch operation (e.g., with a single keystroke). For example, as optimal setting data are set for each scene on a stage during rehearsal of a concert, the setting data are stored in a scene memory for each of the scenes. Then, during an actual performance, the setting data corresponding to a particular scene are reproduced through one-touch operation each time a changeover to that particular scene should take place; such scene reproducing operation is called "scene recall".

Because the mixing systems include some operators for which operated amounts etc. should be newly set in accordance with a situation on a particular occasion, some of the parameters are often excluded from an object of the scene recall. In this connection, "DM 2000 Instruction Manual", published by Yamaha Corporation, February, 2002, discloses in pages 157–163 a mixing system having a function of excluding or excepting some parameters from an object of scene recall (so-called "recall safe function"). Specifically, in the disclosed mixing system, each designated function belonging to a designated channel is excluded or excepted from the object of the scene recall.

However, the channel or parameter to be excluded from the object of the scene recall often differs among various scenes. Therefore, according to the technique disclosed in the above-identified document "DM 2000 Instruction Manual", there would arise a need for a human operator of the mixing system to newly set the recall safe function each time scene recall operation is performed during an actual performance, which would undesirably complicate the necessary operation.

Further, many of the mixing systems known today include display elements, provided near faders for adjusting tone volume etc., for displaying respective channel names etc. each composed of a few characters. The channel names to be displayed on the display elements can be set freely by a human operator via a keyboard or otherwise. Such a technique is disclosed in the above-identified document, e.g. pages 35–47. Also, in the mixing systems known today, each of a plurality of input/output ports for communicating signals from/to external devices can be allocated to a desired input or output channel; such a technique too is disclosed in the above-identified document, e.g. pages 61–67.

However, the disclosed technique presents the problem that, even where any given one of the input/output channels has been assigned a particular channel name, the assigned channel name would become insubstantial or useless if the input/output port allocated to the given input/output channel is changed. As one possible measure for addressing such a problem, different port names may be assigned to the individual input/output ports so that the port names are displayed on the display elements near the faders. But, depending on the form of use of the mixing system, there would sometimes co-exist channels for which the channel names should be displayed and channels for which the port names should be displayed.

SUMMARY OF THE INVENTION

In view of the foregoing, it is an object of the present invention to provide a mixing system control method, mixing system and computer program which allow optimal scene recall operation to be performed with ease.

It is another object of the present invention to provide a mixing system control method, mixing system and computer program which allow optimal name display to be performed in accordance with a form of use of the mixing system.

Here, for ease of understanding, numerals in parentheses indicate reference numerals of corresponding components employed in embodiments to be detailed later.

According to a first aspect of the present invention, there is provided a mixing system control method, which comprises: a step of storing a current data set on each occasion in a current data storage region (26), the current data set including a plurality of setting data and range data that specifies, from among the plurality of setting data, particular setting data that should be included in (or should belong to) a recall range; a storage step of storing a plurality of scene data sets in a scene storage region (24), each of the scene data sets being composed of the current data set on one occasion; a signal processing step of controlling characteristics of a plurality of input signals on the basis of the setting data stored in the current data storage region and selectively mixing the input signals of the controlled characteristics in a plurality of different mixtures, so as to provide a plurality of mixed signals; a setting data change step of changing at least a portion of the setting data in response to detection of setting operation; a range data setting step of setting the range data stored in the current data storage region, in response to detection of recall range setting operation; a scene storage step of storing the current data set in the current data storage region (26) into the scene storage region (24), in response to detection of storing operation; and a scene recall step of, in response to detection of recalling operation for a designated one of the scene data sets stored in the scene storage region (24), writing, into the current data storage region (26), the particular setting data specified by the corresponding range data as data to be included in the recall range from among the plurality of setting data contained in the designated scene data set.

In a preferred embodiment, the setting data change step is a step where a user specifies setting data to be included in the recall range by a selected one of first operation for designating setting data to be recalled and second operation for designating setting data to be not recalled.

Preferably, in the storage step, all the setting data are stored in the scene storage region (24) irrespective of whether or not the setting data belong to the recall range, and the mixing system control method further comprises a step of, in response to predetermined operation, writing all the setting data into the current data storage region (26) irrespective of whether or not the setting data belong to the recall range.

According to a second aspect of the present invention, there is provided a control method for a mixing system of a type which includes a plurality of input ports for receiving respective ones of a plurality of signals and where the signals received via the plurality of input ports are allocated to a plurality of input channels, the signal allocated to each of the input channels is subjected to an adjustment process based on operation of a respective one of operators provided in corresponding relation to the input channels, and the signals having been subjected to the adjustment process are further subjected to a mixing process to provide mixed signals. The control method comprises: a correspondency setting step of setting correspondency between the plurality of input ports and the plurality of input channels; a port name assignment step of assigning a different port name to each of the plurality of input ports by designating a different string of characters for each of the input ports; a name-assignment-mode setting step of designating one of a first name assignment mode and second name assignment mode for any desired one of the input channels; a first name assignment step of assigning a channel name to the desired input channel in accordance with a designated string of characters, on condition that the first name assignment mode is set by the name-assignment-mode setting step; a second name assignment step of assigning a channel name to the desired input channel on the basis of a port name of the input port corresponding to the desired input channel, on condition that the second name assignment mode is set by the name-assignment-mode setting step; and a display step of displaying the channel name, assigned by the first name assignment step or the second name assignment step, in association with the operator provided for the desired input channel.

According to a third aspect of the present invention, there is provided a control method for a mixing system of a type which includes a plurality of input ports for receiving respective ones of a plurality of signals and where the signals received via the plurality of input ports are allocated to a plurality of input channels, the signal allocated to each of the input channels is subjected to an adjustment process based on operation of a respective one of operators provided in corresponding relation to the input channels, and the signals having been subjected to the adjustment process are further subjected to a mixing process to provide mixed signals. Here, the control method comprises: a correspondency setting step of setting correspondency between the plurality of input ports and the plurality of input channels; a port name assignment step of assigning a different port name to each of the plurality of input ports by designating a different string of characters for each of the input ports; a channel name assignment step of assigning a different channel name to each of the plurality of input channels by designating a different string of characters for each of the input channels; a determination step of determining, for each of the input channels, whether or not the channel name assigned to the input channel includes a predetermined code; and a display step of, when it is determined that the channel name includes the predetermined code, displaying the channel name in association with the operator provided for the input channel while replacing the predetermined code with the port name corresponding to the input channel.

Preferably, in the port name assignment step, the predetermined code can be entered only at a location of a first character of the channel name.

The present invention may be constructed and implemented not only as the method invention as discussed above but also as an apparatus invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE EMBODIMENTS

1. Hardware Setup of Embodiment

Now, a description will be made about an example general hardware setup of a mixing system 1 in accordance with an embodiment of the present invention, with reference to FIG. 1.

Figure 2:
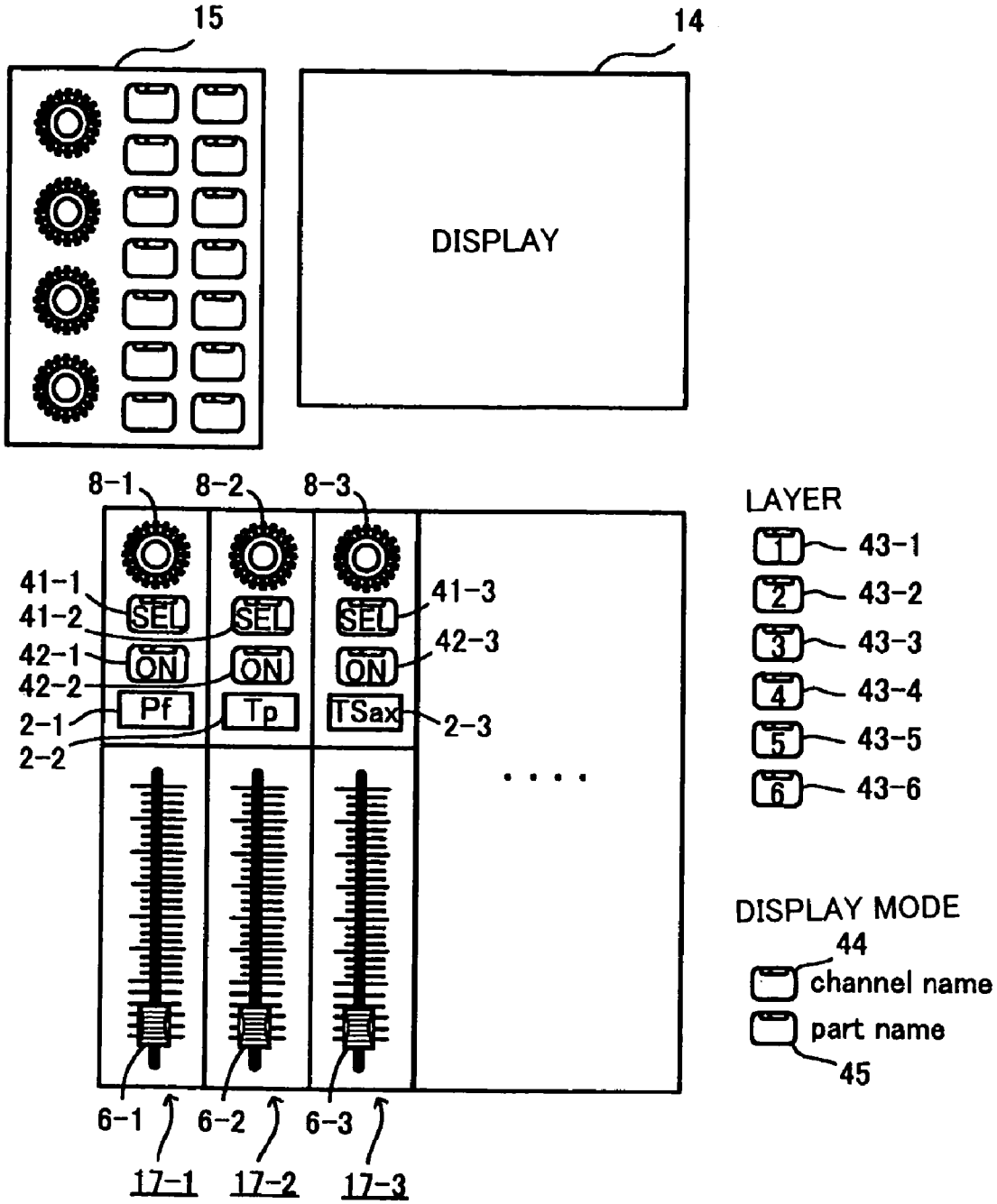
FIG. 2 is a top plan view of a principal portion of an operation panel employed in the mixing system of FIG. 1.

The mixing system 1 includes an electric fader section 6 for adjusting signal levels of individual input/output channels in response to operation by a human operator. The electric fader section 6, including a plurality of electric faders 6-1–6-n (see FIG. 2) is constructed so that its operating position is automatically set in accordance with an operation command given via a bus 28. The mixing system 1 also includes an individual display section 2 that includes a plurality of display elements 2-1–2-n (see FIG. 2) that correspond to the electric faders 6-1–6-n on a one-to-one basis; a string of a predetermined number of characters (e.g., alphabetical letters) is displayed on each of the individual display elements 2-1–2-n.

Figure 1:
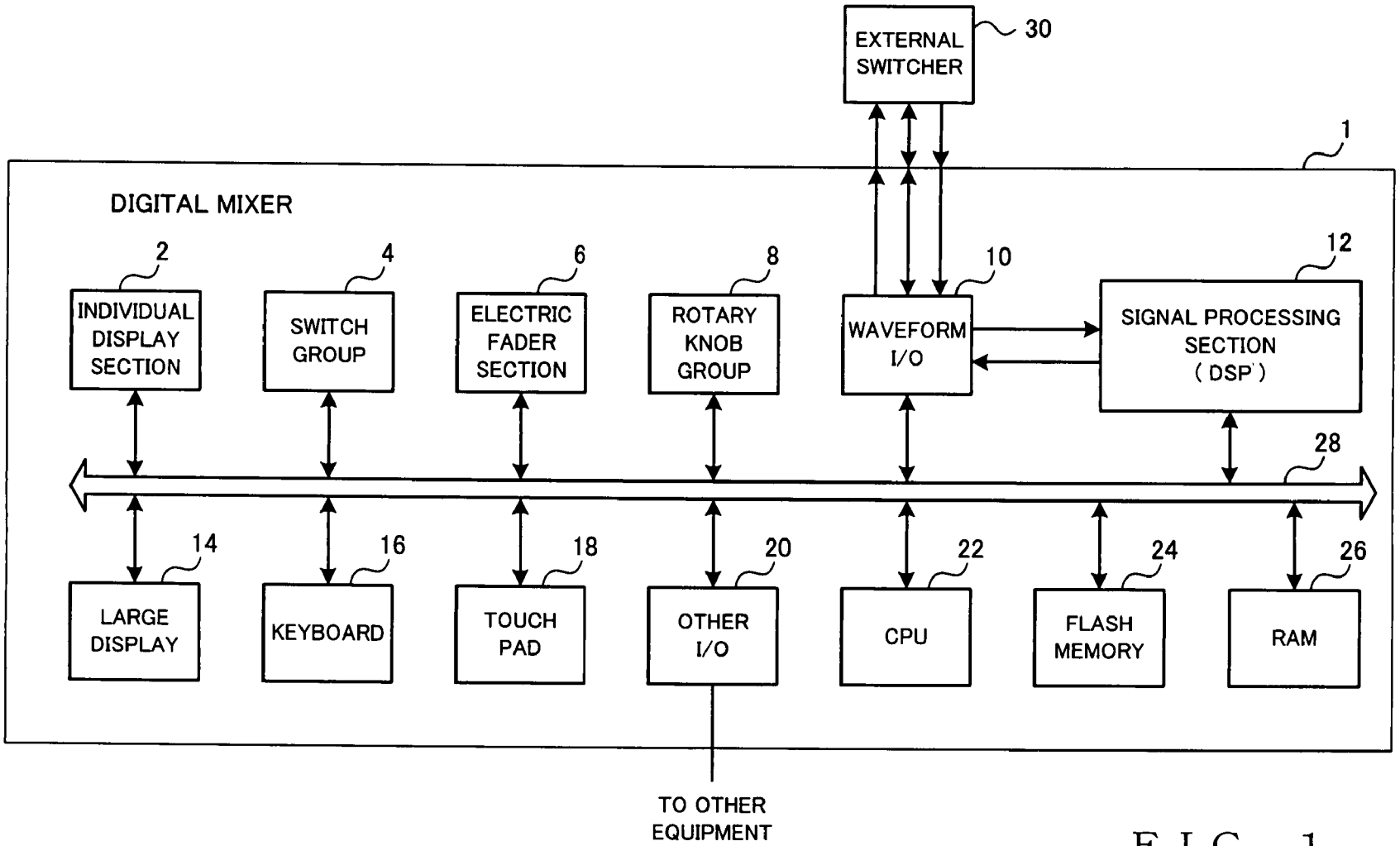
FIG. 1 is a block diagram showing an example hardware setup of a mixing system in accordance with en embodiment of the present invention.

Further, in the mixing system 1 of FIG. 1, a switch group 4 includes various switches and LED keys, and respective illuminating states of LEDs built in the LED keys are set via the bus 28. Rotary knob group 8 includes a plurality of rotary knobs (knob-shaped operators) 8-1–8-n(see FIG. 2) provided in corresponding relation to the electric faders 6-1–6-n, and various other rotary knobs. Respective operated amounts of these rotary knobs are output via the bus 28.

Reference numeral 10 represents a waveform I/O section, which performs input/output of analog or digital sound signals. In the instant embodiment, mixing processing, effect processing, etc. of various sound signals are all carried out in a digital manner. However, in many cases, sound signals input to the mixing system 1 from the outside and sound signals to be output to the outside are in analog representation. Therefore, the waveform I/O section 10 has a plurality of slots, and any desired one or more of cards having various functions are inserted, as necessary, in the slots of the waveform I/O section 10; among the various functions of the cards insertable in the slots are microphone-level analog input, line-level analog input, digital input, analog output and digital output functions. Necessary conversion processes can be performed by these cards. Each of the cards has one or more ports.

The mixing system 1 of FIG. 1 also includes a signal processing section 12 which is in the form of a group of DSPs (Digital Signal Processors). The signal processing section 12 performs mixing processing and effect processing on digital sound signals supplied via the waveform I/O section 10, and it outputs processed results to the waveform I/O section 10. Large display device 14 includes a flat panel display having a resolution, for example, in the order of "1024×768".

Keyboard 16 is provided for entering a string of characters, operation command, etc. Touch pad 18 is provided for controlling a mouse cursor position etc. on the large display device 14, depressing a button or the like displayed on the large display device 14, and the like. Other I/O section 20 performs input/output of a time code and other information from/to any of various external equipment. Reference numeral 22 represents a CPU that controls various components of the mixing system 1 via the bus 28 on the basis of control programs as will be later described. Flash memory 24 has the control programs stored in its program storage region. RAM 26 is used as working memories for the CPU 22.

Reference numeral 30 represents an external switcher that is connected to the waveform I/O section 10 as necessary, and sound signals of a plurality of channels input to the external switcher 30 are supplied to various ports within the waveform I/O section 10 after connection state changes are made as necessary. The external switcher 30 includes a plurality of input terminals and output terminals, and connection states between these input terminals and output terminals can be changed as desired. Then, a control signal indicative of the current connection states in the external switcher 30 is input to the mixing system 1 via the other I/O section 20.

In the instant embodiment of the mixing system 1, a set of various parameters (current data set) for controlling current operation of the system 1 are stored in a current data storage region provided in the RAM 26. Namely, once the human operator operates any of the switches 4, electric fader section 6, rotary knob group 8, keyboard 16, touch pad 18, etc., the current data set is updated, and the mixing processing and effect processing by the signal processing section 12, displaying states of the individual display section 2 and large display device 14, LED illuminating states of the switches 4, individual fader positions of the electric fader section 6, etc. are controlled on the basis of the current data set. The current data set can be stored as a "scene data set" in a scene storage region of the flash memory 24 or in an external storage device (not shown) connected to the other I/O section 20, as necessary. In the scene storage region, there can be stored a plurality of scene data sets representative of a plurality of different scenes. Therefore, when a scene change is to be made, the human operator can reproduce (recall) a necessary scene in the current data storage region through one-touch operation, by just selecting and calling up the necessary scene. Note that the current data set also includes other data (e.g., setting parameters of a later-described recall-safe function) that are not stored in the scene storage region, and such other data are neither stored nor recalled.

2. Construction of Mixing Algorithms in the Embodiment

Figure 3:
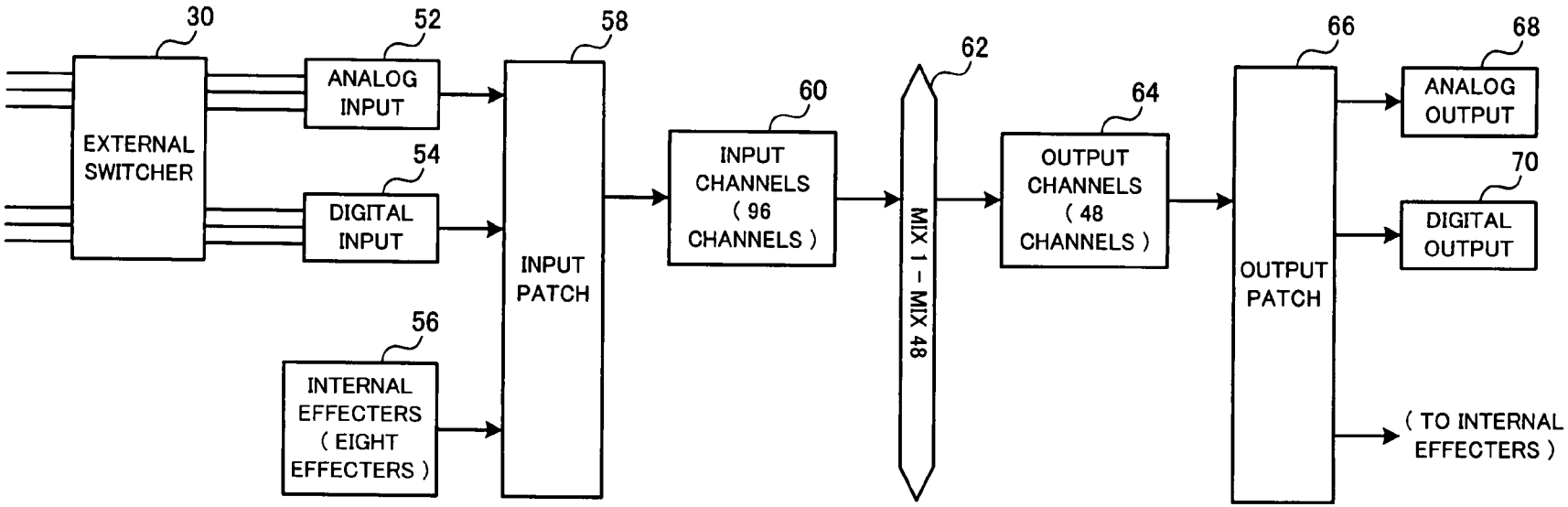
FIG. 3 is a block diagram explanatory of mixing algorithms employed in the mixing system.

The following paragraphs describe exemplary details of algorithms implemented in the signal processing section 12 etc. of the mixing system 1, with reference to FIG. 3.

In FIG. 3, reference numeral 52 represents an analog input section, which, upon receipt of a microphone-level or line-level analog sound signal, converts the analog sound signal into a digital sound signal and supplies the converted digital sound signal to the signal processing section 12. Reference numeral 54 represents a digital input section, which, upon receipt of a digital sound signal, converts the digital sound signal into an internal format of the signal processing section 12. 68 represents an analog output section, which converts a digital sound signal, supplied from the signal processing section 12, into an analog sound signal and outputs the converted analog sound signal to the outside. 70 represents a digital output section, which converts a digital sound signal of the internal format, supplied from the signal processing section 12, into a digital sound signal of a predetermined format (AES/EBU, ADAT, TASCAM or the like) and outputs the thus-converted digital sound signal to the outside.

Whereas the above-described arrangements are implemented by the waveform I/O section 10, which is separate hardware from the signal processing section 12, and various cards inserted in the waveform I/O section 4, the other arrangements than the above-described are implemented by programs running in the signal processing section 12. Reference numeral 60 represents input channel adjustment sections, which perform adjustment of sound volume, sound quality, etc. on up to 96 input channels on the basis of operation of the electric fader section 6, rotary knob group 8, etc. Built-in internal effecter 56 performs effect processing on sound signals of up to eight channels. Input patch section 58 allocates sound signals, supplied from various ports of the input sections 52 and 54 and internal effecter 56, to given input channels of the input channel adjustment sections 60.

Reference numeral 62 represents a MIX bus group, which comprises 48 channels of MIX buses. In each of the MIX buses, digital sound signals of the individual input channels are mixed together. In each of the input channels, it can be set, for each of the MIX buses, whether or not the sound signal should be supplied to the individual MIX buses. If the sound signal should be supplied to the MIX buses, send (i.e., signal delivery) levels to the MIX buses can also be set independently on the channel-by-channel basis. Reference numeral 64 represents MIX output channel sections, which perform level adjustment and sound quality adjustment on the mixed signals output from these MIX buses. Output patch section 66 allocates the adjusted results of the MIX output channel sections 64 to desired output ports of the output sections 68 and 70 or to the above-mentioned internal effecter 56.

Figure 4:
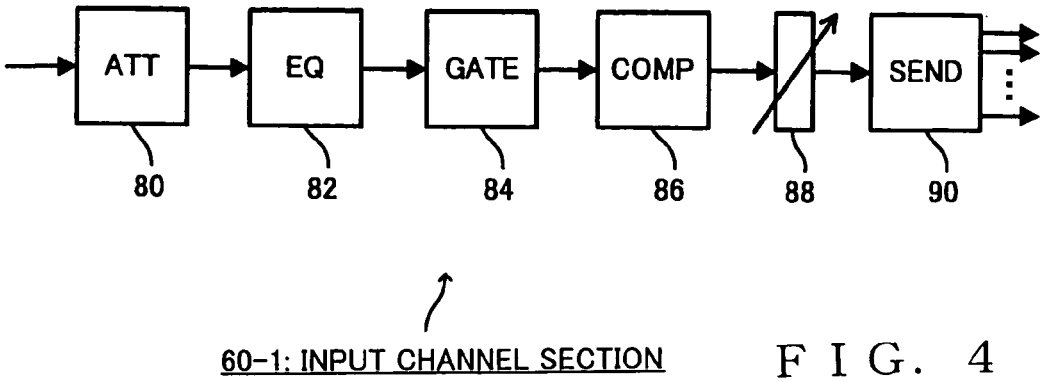
FIG. 4 is a detailed block diagram of a principal portion of the mixing algorithms of FIG. 3.

Algorithms employed in the input channel adjustment sections 60 are constructed in a manner as illustratively shown in FIG. 4. In the figure, reference numeral 60-1 represents a first input channel adjustment section that performs sound volume and sound quality adjustment of the first input channel. The first input channel adjustment section 60-1 includes an attenuator 80 that attenuates a supplied sound signal, an equalizer section 82 that sets frequency characteristics of the sound signal, and a noise gate section 84 that performs a gate process for reducing noise by attenuating each sound signal component smaller than a predetermined level.

The first input channel adjustment section 60-1 also includes a compressor section 86 for compressing a dynamic range of the sound signal, and a sound volume adjustment section 88 that attenuates the sound signal in accordance with an operated amount of the electric fader etc. Reference numeral 90 represents a send adjustment section that switches between whether or not the sound signal should be supplied from the first input channel adjustment section 60-1 to the individual MIX buses. If the sound signal should be supplied to the MIX buses, respective send (i.e., signal delivery) levels to the MIX buses are set. Whereas the algorithm for the first input channel adjustment section 60-1 corresponding to the first input channel has been detailed above, a similar input channel adjustment section or MIX output channel is provided for each of the other input channels or MIX output channels.

3. Construction of Upper Operation Panel

The following paragraphs describe an example construction of an upper operation panel of the mixing system 1.

Reference numerals 17-1–17-n represent channel strips, each of which is assigned to a different one of the input channels, MIX output channels or the like. These channel strips are arranged in a horizontal row on the operation panel. Each of the electric faders 6-1–6-n is provided in a different one of the channel strips 17-1–17-n. The individual display elements 2-1–2-n are provided in corresponding relation to the electric faders 6-1–6-n and positioned adjacent to the top of the corresponding faders 6-1–6-n to indicate respective names of the corresponding faders 6-1–6-n.

The operation panel also includes ON keys 42-1–42-n for switching ON/OFF states of the input channels allocated to the electric faders 6-1–6-n, etc., and SEL keys 41-1–41-n. Any one of the SEL keys 41-1–41-n is turned on to select one of the channels which should be subjected to detailed setting, such as that for the equalizer section 82. The rotary knobs 8-1–8-n are each provided for setting an attenuation rate of the attenuator section 80 etc. in a corresponding one of the input channels.

Although the number of the input channels and the number of the MIX output channels in the instant embodiment are "96" and "48", respectively, there are provided only "24" channel strips. In some cases, DCA faders may be provided in addition to the faders of the input and output channels, as will be later detailed. Thus, the input channels and MIX output channels are divided into a plurality of layers, and the layers to be allocated to the channel strips 17-1–17-n are designated so that any desired one of the channels can be subjected to adjustment. Layer keys 43-1–43-6 are each provided for selecting one of the layers to be allocated to the channel strips 17-1–17-n. For example, the layer key 43-1 is operable to select the 1st-24th input channels, the layer key 43–2 is operable to select the 25th-48th input channels, and so on.

The operation panel also includes display mode selection keys 44 and 45 for selecting either a "channel name display mode" in which channel names are designated as names to be displayed on the individual display elements 2-1–2-n, or a "port name display mode" in which port names are designated as the names to be displayed on the individual display elements 2-1–2-n. Selected channel adjustment section 15, which includes a plurality of keys, rotary knobs, etc., is provided for making detailed settings for a particular channel selected via any one of the SEL keys 41-1–41-n, such as those for the attenuator section 80, equalizer section 82, gate section 84, compressor section 86 and send adjustment section 90 of the selected channel.

4. Operation of the Embodiment 4.1. General Operation

In the instant mixing system, once there occurs an operation event of any one of the operators, such as the faders, rotary knobs and keys, a routine corresponding to the operation event is started up. Particularly, once there occurs an operation event pertaining to ordinary sound volume/sound quality adjustment except for special operation events (e.g., those of setting of a port name or channel name, recording of scene data, scene recall, layer section, etc.), the corresponding parameter value (setting data) in the current data set is updated on the basis of the content of the operation.

For example, once any one of the electric faders and rotary knobs is operated, control data (e.g., level data or frequency data) corresponding to a new operated amount of the operated electric fader or rotary knob is stored at a corresponding location of the current data set. If any one of the keys is operated, a new ON/OFF state of the operated key is stored at the corresponding location of the current data set. Then, various parameters in the mixing algorithms (FIG. 3), i.e. stored contents of various parameter registers provided in the signal processing section 12, are updated on the basis of the updated current data set, so that the new operation of the fader or rotary knob will be reflected in sound signals to be output. Also, on the basis of the updated current data set, various settings of the operation panel are executed, such as illumination/deillumination of the LEDs in the keys or LEDs around the rotary knobs, display change of the various display elements and display device, driving of the electric faders, etc.

4.2. Port Name Setting

Figure 5:
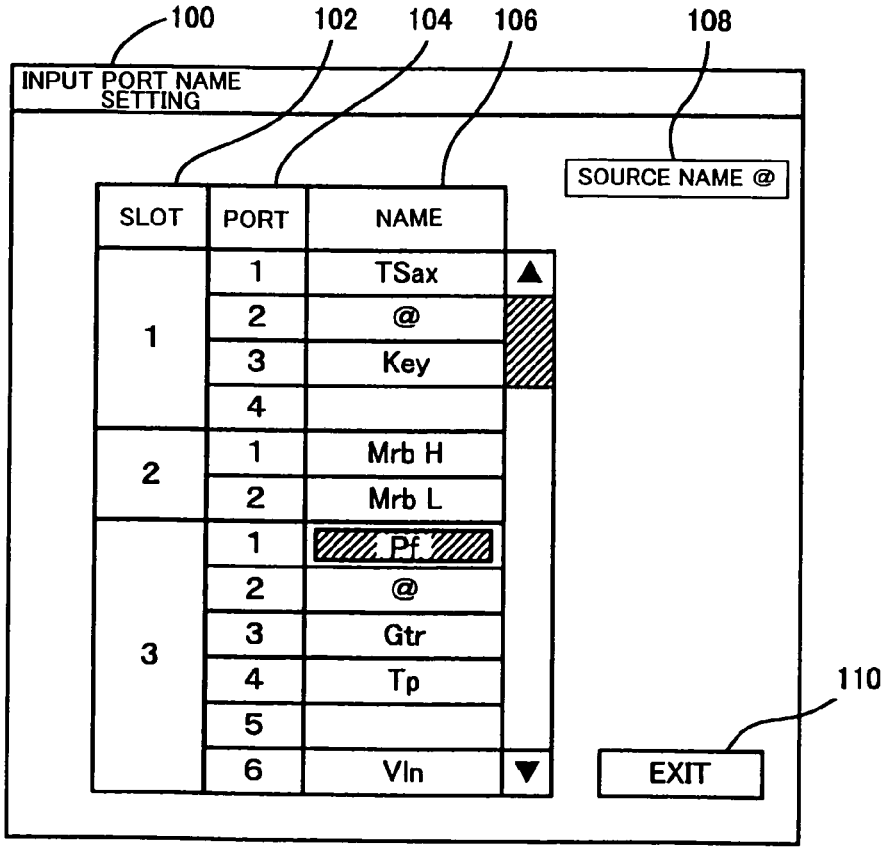
FIG. 5 is a diagram showing an example of an input-port-name setting window displayed on a display device of FIG. 1.

Once predetermined operation is perform via the keyboard 16 for setting a port name, an input-port-name setting window 100 is caused to appear on the large display device 14 as shown illustrated in FIG. 5.

In FIG. 5, reference numeral 102 represents a slot number display section included in the input-port-name setting window 100 for displaying respective names of the plurality of slots provided in the waveform I/O section 10. As noted earlier, cards having various functions are insertable in the individual slots, and each of the cards has one or more ports. The input-port-name setting window 100 also includes a port number display section 104 for displaying respective port numbers of the ports, and a port name display section 106 for displaying port names assigned to the individual ports. Keyboard cursor (indicated by a hatched block in the figure) can be placed on the port name display section 106, so that the port name indicated by the cursor can be edited by the human operator entering characters via the keyboard 16.

The input-port-name setting window 100 also includes a source name designating button 108, and, upon depression of the button 108, a predetermined code "α" is input to a block indicated by the keyboard cursor on the port name display section 106. The code "α" means that a "source name", such as a name assigned to individual signals in the external switcher 30 or other sound source, is used directly as the port name. Note that the predetermined code "α" can be input not only by the source name designating button 108 but also by the human operator performing predetermined operation (e.g., entering a predetermined character while at the same time depressing a control key) on the keyboard 16.

However, the predetermined code "α" can be entered only at a location of the first character of the port name. By thus allowing the predetermined code "α" to be entered only at the location of the first character through special operation, such as depression of the source name designating button 108 or entry of a predetermined character with the control key depressed on the keyboard 16, the instant embodiment can reliably prevent the human operator from entering the predetermined code "α" by mistake, thereby minimizing human errors. Reference numeral 110 represents an EXIT button, which causes the window 100 to be closed upon depression of the button 110. Further, performing other predetermined operation via the keyboard 16 can cause an output-port-name setting window, constructed similarly to the input-port-name setting window 100, to be displayed on the large display device 14, and any desired output port name can be edited in generally the same manner as in the above-described input port name.

4.3. Channel Name Setting

Figure 6:
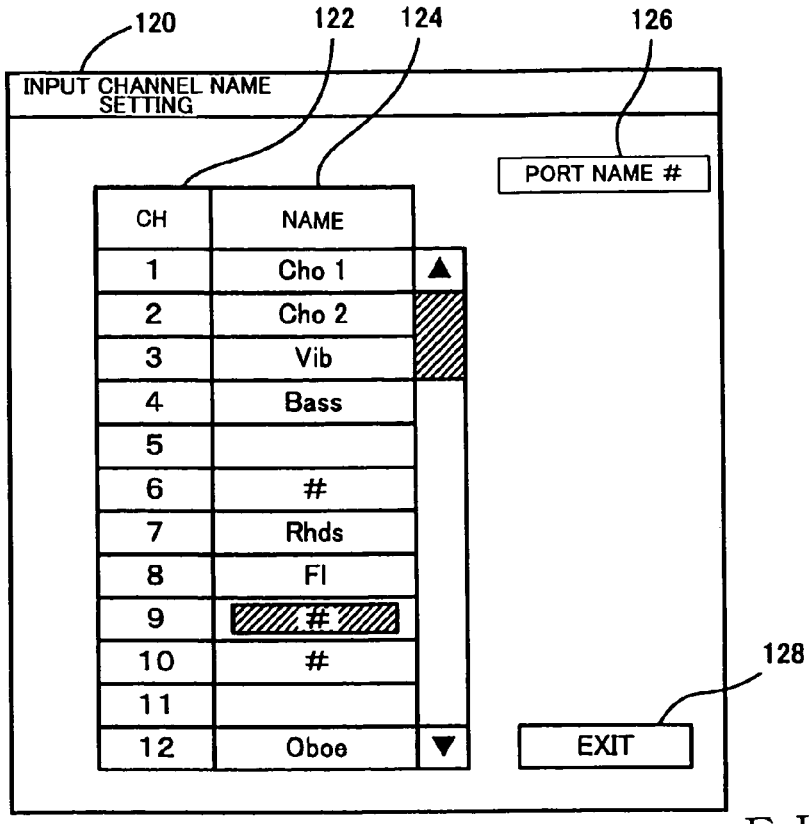
FIG. 6 is a diagram showing an example of an input-channel-name setting window displayed on the display device of FIG. 1.

Once predetermined operation is perform via the keyboard 16 for setting a channel name, an input-channel-name setting window 120 is caused to appear on the large display device 14 as shown illustrated in FIG. 6.

In FIG. 6, reference numeral 122 represents a channel number display section included in the input-channel-name setting window 120 for displaying respective numbers of the input channels, and a channel name display section 124 for displaying names assigned to the input channels. The keyboard cursor (indicated by a hatched block in the figure) can be placed on the channel name display section 124, so that the channel name indicated by the cursor can be edited by the human operator entering characters via the keyboard 16.

The input-channel-name setting window 120 also includes a port name designating button 126, and, upon depression of the button 126, a predetermined code "#" is input to a block indicated by the keyboard cursor on the channel name display section 124. The code "#" means that a name of an input port allocated to the input channel in question is used directly as a channel name. Note that the predetermined code "#" can be input not only by the port name designating button 126 but also by the human operator performing predetermined operation on the keyboard 16. As with the above-described predetermined code "α", this predetermined code "#" can be entered only at a location of the first character of the channel name. Reference numeral 128 represents an EXIT button, which causes the input-channel-name setting window 120 to be closed upon depression of the button 128.

Further, performing other predetermined operation via the keyboard 16 can cause a MIX-output-channel-name setting window, constructed similarly to the input-channel-name setting window 120, to be displayed on the large display device 14, and any desired MIX output channel name can be edited in generally the same manner as the above-described input channel name.

4.4. Setting of Range-selected Recall Function

In the instant embodiment, current settings of the mixing system 1 can be stored as a "scene data set" in the flash memory 24 and the like and the thus-stored scene data can be recalled, as noted above. At that time, only a selected portion of the setting data, rather than the setting data pertaining to all parameters included in the scene data set, can be recalled; such operation is called "range-selected recall".

Figure 8:
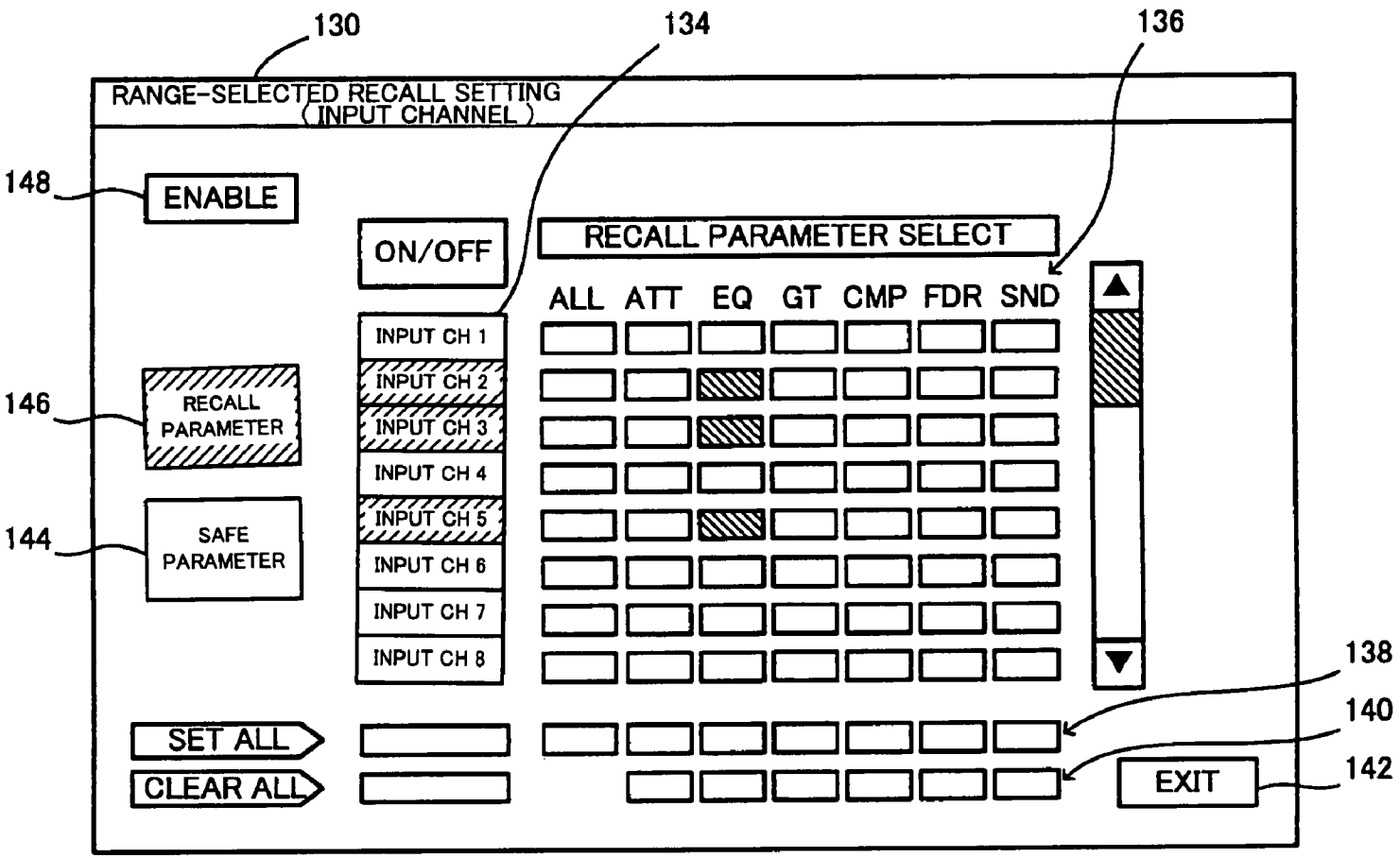
FIG. 8 is a diagram showing an example of a range-selected-recall setting window displayed on the display device.
Figure 9:
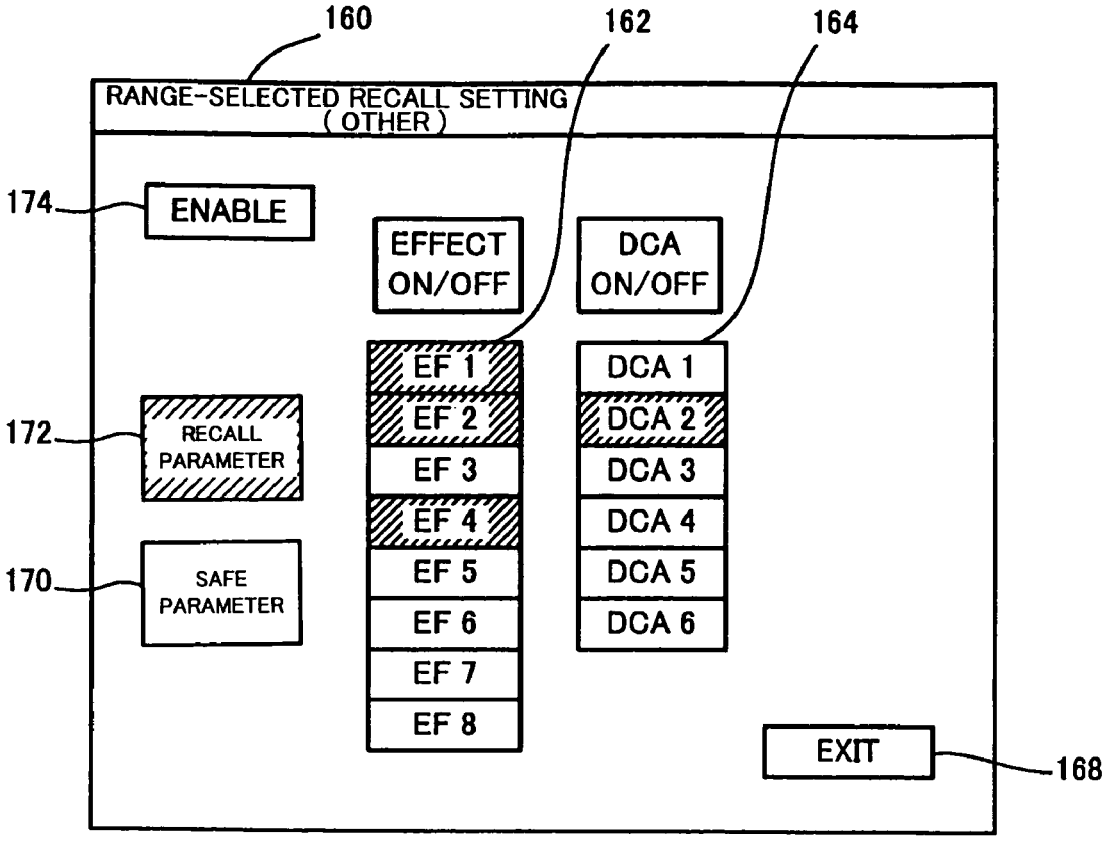
FIG. 9 is a diagram showing another range-selected-recall setting window displayed on the display device.

Once predetermined operation is perform via the keyboard 16 for initiating setting of the range-selected recall, a range-selected-recall setting window 130 is caused to appear on the large display device 14 as shown illustrated in FIGS. 8 and 9. Reference numeral 130 represents a recall range setting window for an input channel, and 160 a recall range setting window for an effect and DCA. Although not specifically shown, the instant embodiment is constructed to also display a recall range setting window for a MIX output channel in addition to the above-mentioned recall range setting windows. These windows are each intended to set range-selected recall for the "current data set". Namely, when the human operator performs storage operation by designating a scene number, the current data set, including data of a recall range set via the window 130, window 160 or the like, are stored in the scene memory as a scene of the designated scene number. Note that various buttons shown in the windows 130, 160 etc. can be turned on or off by the human operator moving a cursor of a pointing device, such as the mouse or touch pad, and activating a click switch attached to the pointing device.

The range-selected recall setting window 130 includes mode selecting buttons 144 and 146 for selecting either one of a recall parameter mode (R mode) and a safe parameter mode (S mode). Here, the R mode is an operation mode where selected parameters are set as an object of the recall with the other parameters excluded from the object of the recall, while the S mode is an operation mode where selected parameters are excluded from the object of the recall with the other parameters set as the object of the recall.

The range-selected recall setting window 130 also includes an input channel selection section 134 that includes a plurality of buttons corresponding to the input channels. Although the input channel selection section 134 and parameter selection section 136 are shown in FIG. 8 only for input channels "ch1"–"ch8", these sections 134 and 136 can be displayed for all of input channels "ch1"–"ch96" using a scroll bar provided at a right end of the setting window 130. In the input channel selection section 134, the input channels corresponding to turned-on buttons (indicated by hatched blocks in the figure) are input channels to be selected, i.e. input channels to be recalled in the R mode or to be not recalled in the S mode.

The range-selected recall setting window 130 also includes a parameter selection section 136 that includes "ALL", "ATT", "EQ", "GT", "CMP", "FDR" and "SND" buttons provided for each of the input channels. The "ATT", "EQ", "GT", "CMP", "FDR" and "SND" buttons for each of the input channels correspond to the attenuator section 80, equalizer section 82, gate section 84, compressor section 86, sound volume adjustment section 86 and send adjustment section 90 of the input channel, and each of these buttons is operable to switch whether or not one or more parameters (parameter group) in the corresponding section 80–90 should be set as an object of selection. The "ALL" button is operable to switch whether or not all of the parameters in the sections 80–90 should be set as an object of selection. When the "ALL" button is turned on, all of the "ATT", "EQ", "GT", "CMP", "FDR" and "SND" buttons are automatically set to the OFF state.

The range-selected recall setting window 130 also includes a "SET-ALL" button section 138 that includes a "CHANNEL" button provided immediately beneath the input channel selection section 134, and "ALL", "ATT", "EQ", "GT", "CMP", "FDR" and "SND" buttons provided immediately beneath the parameter selection section 136. When the "CHANNEL" button is turned on, all of the buttons belonging to the input channel selection section 134 are set to the ON state. Further, when any one of the "ALL", "ATT", "EQ", "GT", "CMP", "FDR" and "SND" buttons belonging to the "SET-ALL" button section 138 is turned on, all of the buttons of the same name as the turned-on button, belonging to the parameter selection section 136, are automatically set to the ON state.

The range-selected recall setting window 130 also includes a "CLEAR-ALL" button section 140 that includes a "CHANNEL" button corresponding to the input channel selection section 134, and "ATT", "EQ", "GT", "CMP", "FDR" and "SND" buttons corresponding to the parameter selection section 136. When the "CHANNEL" button is turned on, all of the buttons belonging to the input channel selection section 134 are set to the ON state. Further, when any one of the "ATT", "EQ", "GT", "CMP", "FDR" and "SND" buttons is turned on, all of the buttons of the same name as the turned-on button, belonging to the parameter selection section 136, are automatically set to the OFF state. Reference numeral 142 represents an EXIT button, which causes the window 130 to be closed upon depression of the button 142, and 148 an ENABLE button for setting whether or not the range-selected recall should be enabled (made valid) for the current data set.

According to a default to be applied when the current data set or scene is initialized in response to an instruction of the human operator, the ENABLE button 148 is placed in the OFF position (i.e., the range-selected recall is made invalid), the mode selecting buttons 144 and 146 are in the safe parameter mode position, and the input channel selection section 134 is in the OFF position (i.e., all the input channels are set as the object of the recall). In the default, where the ENABLE button 148 is in the OFF position as noted above, the inventive mixing system 1 can be used in much the same manner as the conventional mixers having no range-selected recall function, thereby giving no unnecessary confusion even to a human operator who does not know about the range-selected recall function.

Further, in FIG. 9, reference numerals 170 and 172 represent mode selecting buttons for selecting either one of the recall parameter mode (R mode) and the safe parameter mode (S mode) similarly to the above-mentioned mode selecting buttons 144 and 146. Effecter selection section 162 includes eight buttons corresponding to the eight channels in the internal effecter 56. DCA selection section 164 includes six buttons corresponding to six DCA channels. In each of the effecter selection section 162 and DCA selection section 164, one or more channels corresponding to the turned-on buttons are set as the object of selection.

DCA (Digital Controlled Amplifier or Digital Controlled Attenuator) scheme employed in the instant embodiment is explained briefly below. The DCA scheme is a technique where a same or common fader (DCA fader), separate from the faders of the input channels, is allocated to a plurality of input channels and where gains set by the faders of the individual input channels are multiplied by a gain set by the DCA fader so as to determine respective gains of the plurality of input channels. The DCA mode is used primarily in sound volume control of a large-size musical instrument, such as a piano or drum, or a part of an orchestra.

Reference numeral 168 represents an EXIT button, which causes the recall range setting window 160 to be closed upon depression of the button 168, and 174 an ENABLE button for setting whether or not the range-selected recall should be enabled for the current scene. Because whether or not the range-selected recall should be enabled is determined per scene, the state of the ENABLE button 174 is interlocked to the ENABLE button 148 included in the range-selected recall setting window 130. Settings of the range-selected recall made via the windows 130 and 160 are stored in the RAM 26 as part of the current data set. Therefore, when the current data set is stored in the flash memory 24 or the like as a scene data set, the settings of the range-selected recall are also stored as part of a scene data set.

Figure 10A:
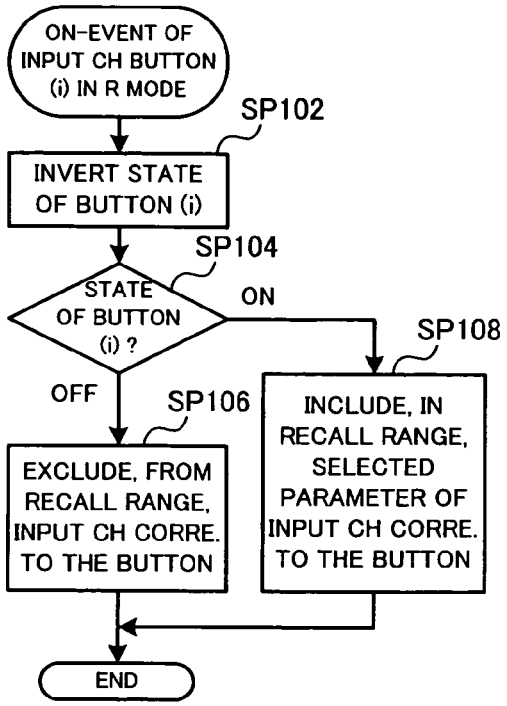
FIGS. 10A–10C are flow charts of control programs employed in the mixing system.

Now, a description will be given about processes carried out once any one of the buttons (button of an i-th input channel) belonging to the input channel selection section 134 is depressed, with reference to FIGS. 10A and 10B. For example, if the button of the i-th input channel is depressed when the operation mode is the R mode, a routine of FIG. 10A is started up. At step SP102 of the routine, the ON/OFF state of the depressed button is inverted. At next step SP104, a determination is made as to whether the state of the button after the inversion is ON or OFF. If the state after the inversion is "OFF" as determined at step SP104, the routine goes to step SP106, where a setting data range pertaining to the i-th input channel corresponding to the depressed button is excluded or excepted from the recall range. If, on the other hand, the state after the inversion is "ON" as determined at step SP104, the routine goes to step SP108, where parameters (a parameter group) selected by the "ATT", "GT", "CMP", and "SND" buttons, pertaining to the setting data range of the i-th input channel corresponding to the depressed button, are included in the recall range.

Figure 10B:
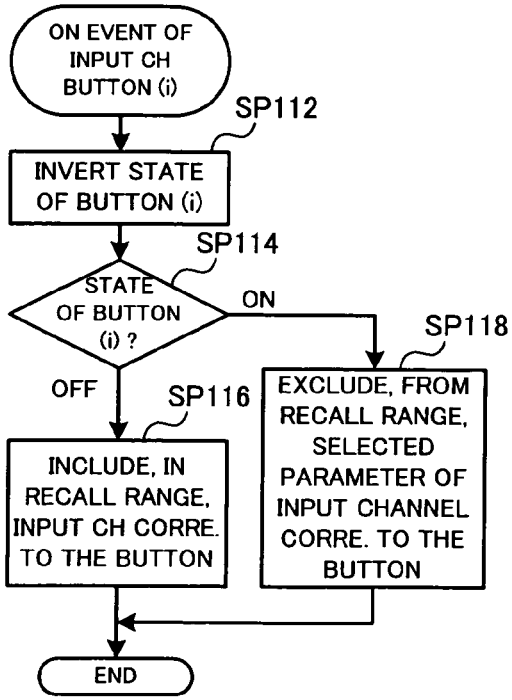

If the button of the i-th input channel is depressed when the operation mode is the S mode, a routine of FIG. 10B is started up. At steps SP112 and SP114, operations similar to those of steps SP102 and SP104 of FIG. 10A are carried out. If the state after the inversion is "OFF" as determined at step SP114, the routine goes to step SP116, where a setting data range pertaining to the i-th input channel corresponding to the depressed button is included in the recall range. If, on the other hand, the state after the inversion is "ON" as determined at step SP114, the routine goes to step SP118, where parameters (a parameter group) selected by the "ALL", "ATT", "EQ", "GT", "CMP", "FDR" and "SND" buttons, pertaining to the setting data range of the i-th input channel corresponding to the depressed button, are excluded from the recall range.

Through the above operations, only one or more parameters which have been turned on in the parameter selection section 136 and for which the corresponding buttons in the input channel selection section 134 have been turned on are set as parameters of an actual selection range (i.e., included in the recall range in the R mode, but excluded from the recall range in the S mode). Example settings made through such operations are illustrated in FIG. 8. In FIG. 8, the R-mode selecting button 136 is ON and hence the operation mode is the R mode. Here, once the "EQ" button in the SET-all button section 138 is turned on, all the "EQ" buttons in the parameter selection section 138 are set to the ON state. However, if all the buttons in the input channel selection section 134 are in the OFF state, a setting of the equalizer section 82 of any one of the input channels will not be included in the recall range. Here, if the buttons of the second, third and fifth input channels in the input channel selection section 134 are turned on as indicated by hatched blocks, the operation of step SP108 is executed in response to each turning-on operation of the buttons, so that only settings of the equalizer sections 82 of the second, third and fifth input channels are included in the recall range.

When the range-selected recall is to be executed in ordinary use condition of the mixing system 1, a common or same parameter group is often set as the object or non-object of the recall range for one or more channels. In the instant embodiment, such setting is permitted by the input channel selection section 134 selecting channels to be set as the object of the recall and SET-ALL button section 138 selecting a parameter group to be set as the object of the recall, so that the number of buttons to be operated by the human operator can be reduced to a significant degree.

Further, the instant embodiment can select a desired one of the recall parameter mode (R mode) and safe parameter mode (S mode) in setting a recall range in the above-described manner. The R mode can be suitably used in setting a relatively small recall range because the number of buttons to be operated by the human operator can be reduced and hence the windows 130 and 160 can be viewed with ease, while the S mode can be suitably used in setting a relatively great recall range. By thus selecting an optimal operation mode depending on the size of a desired recall range, operability of the mixing system 1 can be further enhanced.

4.5. Setting of Recall Safe Function

The mixing system 1 has, in addition to the above-described range-selected recall function, a recall safe function similar to that provided in the conventional mixing system. The recall safe function is a function that sets the current data set so as to except a desired portion of parameters prior to human operator's operation for recalling a scene, to thereby allow the desired portion of parameters to be excluded from the recall range in response to subsequent recalling operation. The range-selected recall function and recall safe function are both based on particular data set in the current data storage region. However, settings of the range-selected recall are allowed to function when a scene data set is recalled after the settings are stored in the scene storage region as part of the scene data, but settings of the recall safe are not stored in the scene storage region and allowed to function when any desired scene is recalled with the settings stored in the current data storage region. Once the human operator performs predetermined operation to start setting the recall safe function, a recall-safe-function setting window, constructed similarly to the range-selected recall setting window 130 and recall range setting window 160, is caused to appear on the large display device 14, via which the human operator can designate, for any desired scene, a parameter group to be included in or excluded from the recall range. As a consequence, what are actually recalled in response to the recalling operation are only setting data associated with a parameter group set as a recall object for both the range-selected recall function and the recall safe function.

4.6. Recording of Scene Data

Once the human operator performs storing operation by designating a scene number "i" via the keyboard 16, data to be preserved from among the current data set are stored in the flash memory 24 or the like as an i-th scene data set. As note earlier, the current data set to be stored in the scene storage region includes setting data of parameters determined on the basis of ON/OFF states of the various buttons and operated amounts of the faders and other operators, and settings of the range-selected recall (range data). Setting data to be excluded from the recall range are also included in the scene data. This is for the purpose of permitting the recall range and the like in the already-created scene data to be subsequently edited freely.

4.7. Scene Recall Process

Figure 10C:
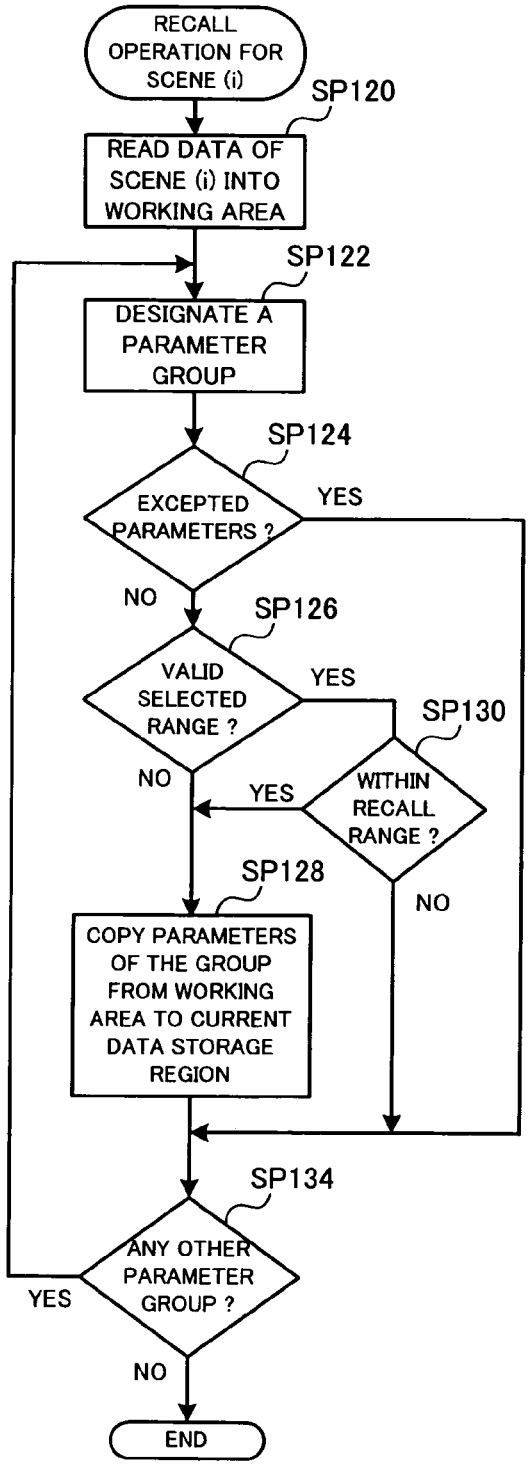
Figure 11:
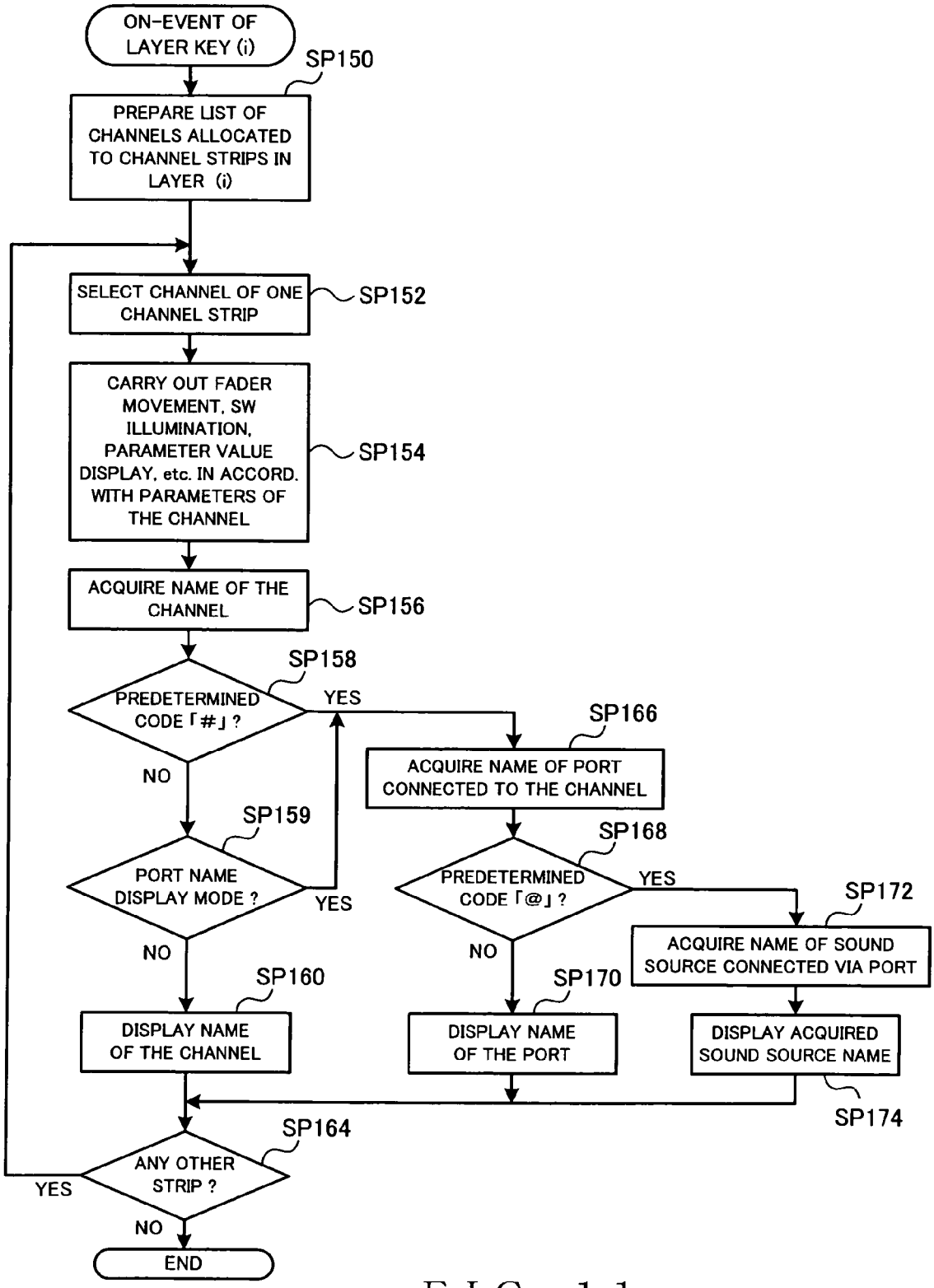
FIG. 11 is a flow chart of another control program employed in the mixing system.

Once the human operator performs recalling operation by designating a scene number i via the keyboard 16, a scene recall process is carried out for the i-th scene. Namely, an i-th scene data set stored in the flash memory 24 or the like is copied to the current data storage region of the RAM 26. Details of the recall process are shown in FIG. 10C. At step SP120 of FIG. 10C, the i-th scene data set is copied to a predetermined working area of the RAM 26.

At next step SP122, a first parameter group (e.g., parameter group for the attenuator section 80 of the first input channel) is selected as an object of processing. At following step SP124, a determination is made as to whether settings of the recall safe function in the selected parameter group are set in an excepted state (i.e., state excluded from the object of the recall) in the current data storage region.

If answered in the negative at step SP124, the process goes to step SP126, where it is determined whether or not the range-selected recall function is valid in the i-th scene data set. Note that validness/invalidness of the range-selected recall function corresponds to the ON/OFF state of the ENABLE button 148, 174 retained in the current data storage region at a time point when the scene data set was stored into the scene storage region. Namely, if the ENABLE button 148, 174 is set in the ON state in the current data storage region, it means that the range-selected recall function is valid, while, if the ENABLE button 148, 174 is set in the OFF state in the current data storage region, it means that the range-selected recall function is invalid. The valid/invalid state of the range-selected recall function of the i-th scene data set can be changed by changing the ON/OFF state of the ENABLE button 148, 174 after recalling the scene data set and then storing again the scene data set as the i-th scene data set.

If the range-selected recall function is valid as determined at step SP126, the process goes to step SP130, where a further determination is made as to whether the parameter group selected as the processing object at step SP122 belongs to the recall range set for the i-th scene data set. With a YES determination, the process goes to step SP128, where the setting data of the selected parameter group are copied from the working region to the current data storage region. Thus, the corresponding portion of the current data set is updated, and various settings on the operation panel are automatically updated.

If, on the other hand, the parameter group selected as the processing object at step SP122 does not belong to the recall range, a "NO" determination is made at step SP130, so that step SP128 is skipped. Further, if the selected parameter group has been excluded from the recall range by the recall safe function, a "YES" determination is made at step SP124, in which case too step SP128 is skipped. Further, if the selected parameter group has been excluded from the recall range by the recall safe function and if the range-selected recall function is invalid as determined at step SP126, then a "NO" determination is made at steps SP124 and SP126, so that the selected parameter group is copied to the current data storage region irrespective of the setting state of the range-selected recall.

Then, at step SP134, a further determination is made as to whether one or more unprocessed parameter groups are left in the working area. With a "YES" determination, the process reverts to step SP122, where one of the unprocessed parameter groups (e.g., parameter group for the equalizer of the first input channel) is designated and the above-described operations of steps SP124–SP128 are repeated for the designated parameter group. Then, when the process proceeds to step SP134 after the operations of steps SP124–SP128 have been completed for all of the parameter groups stored in the working area, a "NO" determination is made at steps SP134 and the routine is brought to an end.

In the instant embodiment, any parameter group not included in the recall range does not influence the current data as clear from the foregoing, and thus, if only settings for the equalizer section 82 are included in the recall range, only these settings for the equalizer section 82 in one scene can also be reproduced, through one-touch operation, in any other scene. Further, by sequentially recalling a plurality of scene data sets having different recall ranges, the instant embodiment can provide a scene comprising a combination of a plurality of scene data sets.

Further, because the instant embodiment permits combined use of the recall safe function and range-selected recall function, it can further simplify human operator's operation. For example, because it is only necessary that settings to be excluded from the recall range irrespective of the scene should be excluded or excepted from the recall range by means of the recall safe function, the instant embodiment can eliminate a need for ascertaining or editing the individual scene data. Further, even where a recall range is previously determined during rehearsal using the range-selected recall function, the recall range can be further narrowed during an actual performance using the recall safe function. In this way, the instant embodiment allows the human operator to promptly deal with various events that were not expected during the rehearsal.

4.8. Selection of Layer

Now, a description will be given about a process performed in response to turning-on of any of the layer keys 43-1–43-6. At step SP150, a list is prepared of channels allocated to the individual channel strips in the layer corresponding to the operated layer key. At next step SP152, the channel allocated to a first or leading one of unprocessed channel strips in the list (e.g., k (=first) channel strip) is selected as a channel to be processed. For example, if the layer key 43-2 has been operated to select the 25th–48th input channels, a list of the 25th–48th input channels is prepared, and the 25th input channel allocated to the first channel strip is selected as a channel to be processed. At following step SP154, various settings for the channel strip 17-k, such as an operated position of the fader 6-k, operated amount of the rotary knob 8-k and ON/OFF state of the ON key 42-k in the channel strip 17-k , is carried out on the basis of data of the 25th input channel included in the current data set.

At next step SP156, the channel name of the channel allocated to the channel strip 17-k is read out from the current data set. Then, at step SP158, it is determined whether or not the read-out channel name is the predetermined code "#". With a "NO" determination, the process goes to step SP159, where a further determination is made as to whether the display mode of the system is currently the port name display mode. If the display mode is the channel name display mode, a "NO" determination is made, so that the process goes to step SP160, where the name of the channel (i.e., channel name having been set via the input-channel-name setting window 120) is displayed on the individual display element 2-k of the channel strip.

If the channel name is the predetermined code "#", or if the display mode is the port name display mode, a "NO" determination is made at step SP158 or SP159, the process moves to step SP166, where the name of the input/output port connected to the channel in question is acquired on the basis of a connecting state of the input patch section 58 or output patch section 66. At next step SP168, a determination is made as to whether the port name is the predetermined code "#". With a "NO" determination, the process goes to step SP170, the name of the port (, i.e., port having been set via the input-port-name setting window 100) is displayed on the individual display element 2-k.

If, on the other hand, the port name is the predetermined code "α", a "YES" determination is made at step SP168, so that the process moves to step SP172. At step SP172, names of sound sources connected via the port (in the illustrated example of FIG. 1, individual signals in the external switcher 30) are acquired from the current data set. At next step SP174, the acquired sound source names are displayed on the display element 2-k.

Upon completion of the operations at steps SP156–SP174, the process proceeds to step SP164, where a further determination is made as to whether or not one or more unprocessed channel strips are included in the above-mentioned channel list. If answered in the affirmative at step SP164, the process reverts to step SP152, where one of the unprocessed channel strips is designated as a processing object, and the above-described operations of steps SP154–SP160 and steps SP166–SP174 are repeated. Once the process proceeds to step SP164 after the above-described operations have been completed for all of the channel strips, a "NO" determination is made, so that the routine is brought to an end.

Thus, in the channel name display mode of the instant embodiment, either one of the name assigned to the channel and the name assigned to the port corresponding to the channel can be selected, in accordance with a character string input to the channel name display section 124, so that the selected name is displayed on the display element 2-k of the channel strip 17-k . Further, because only a channel name (or predetermined code "#") has to be input to the channel name display section 124, there is no need for the human operator to operate any other switch or the like, for example, for causing a port name to be displayed in the channel name display mode, and thus the instant embodiment can achieve enhanced operability. Further, when the channel name is not the predetermined code "#", the channel name may be displayed as-is on the display element 2-k ; in this case, there is no need to read other data, so that the display process can be performed at an increased speed.

5. Modification

The present invention is not limited to the above-described embodiment and may be modified variously as set forth below by way of example.

(1) The various functions of the above-described embodiment of the mixing system have been described above as implemented by programs running on the mixing system. Only such programs may be stored in a recording medium, such as a CD-ROM or flexible disk, and distributed in the recording medium, or may be distributed through a communication path.

Figure 7:
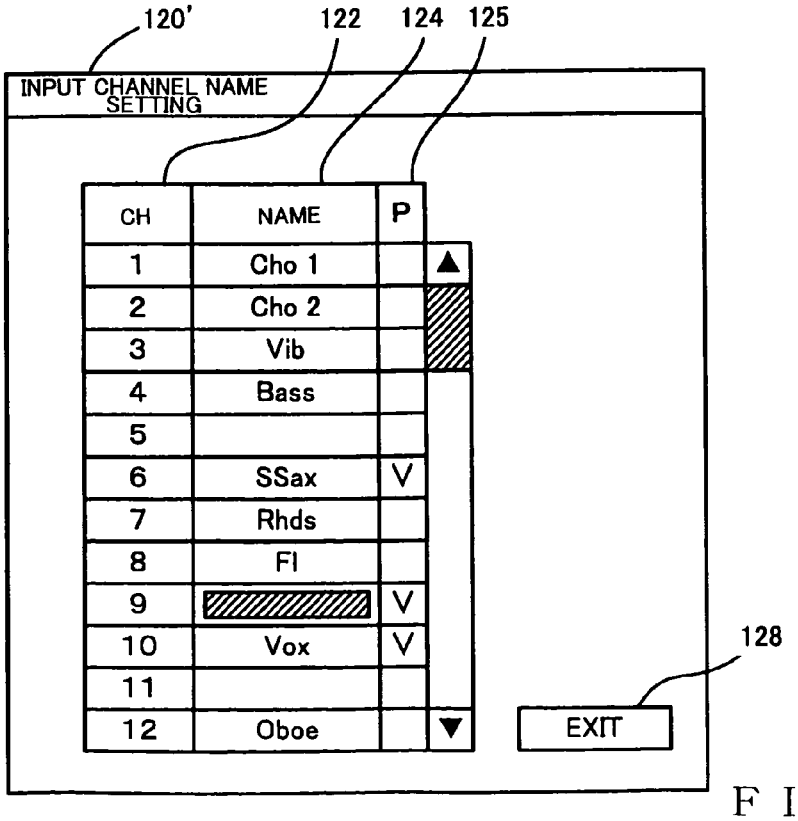
FIG. 7 is a diagram showing a modified example of the input-channel-name setting window of FIG. 6.

(2) In the above-described embodiment, the input-channel-name setting window 120' of FIG. 7 may be displayed in place of the input-channel-name setting window 120. In the input-channel-name setting window 120' of FIG. 7, a channel number display section 122, channel name display section 124 and EXIT button 128 are similar to the elements of the same names in the input-channel-name setting window 120. However, the input-channel-name setting window 120' of FIG. 7 includes a port name designating section 125 having checkboxes provided in corresponding relation to the input channels, in place of the port name designating button 126 of the window 120.

In this case, the human operator can insert or remove a checkmark into or from a desired one of the checkboxes by operating the keyboard 16 and touch pad 18. For a given input channel related to the checkmark-inserted checkbox, the corresponding port name is displayed on the display element 2-k in the channel name display mode too.

(3) In the above-described embodiment, only one set of the display mode selecting keys 44 and 45 is provided in the entire mixing system so that a same display mode is set uniformly for all of the channel strips 17-1–17-n. Alternatively, a set of the display mode selecting keys 44 and 45 may be provided for each of the channel strips 17-1–17-n so that a different display mode can be set independently for each of the channels.

In summary, the present invention arranged in the above-described manner can set in advance a range of to-be-recalled setting data independently per scene, thereby allowing optimal scene recall operation to be performed with utmost ease by a human operator Further, the present invention is arranged to display, for each input channel, a selected one of the name of the channel and the name of the port connected to the channel, and thus it allows optimal name display to be performed in accordance with a form or condition of use of the mixing system.

What is claimed is:

1. A mixing system control method comprising:

a first providing step of providing a current data storage area to store a current data set, the current data set including a plurality of setting data and range data that specifies, from among the plurality of setting data, particular setting data to be recalled;

a second providing step of providing a scene storage area to store a plurality of scene data sets, each of the scene data sets having a same data construction as the current data set;

a signal processing step of controlling characteristics of a plurality of input signals and selectively mixing the input signals of the controlled characteristics in a plurality of different mixtures, on the basis of the setting data stored in the current data storage area, so as to provide a plurality of mixed signals;

a setting data modifying step of modifying at least a portion of the setting data stored in the current data storage area in response to detection of a modifying operation;

a range data setting step of setting the range data stored in the current data storage area, in response to detection of a recall range setting operation;

a scene storage step of, in response to detection of a storing operation for a designated one of the scene data sets stored in the scene storage area, storing the current data set, including said setting data and range data in the current data storage area, to a storage location of the designated scene data in the scene storage area; and a scene recall step of, in response to detection of a recalling operation for a designated one of the scene data sets stored in the scene storage area, writing the particular setting data specified by the corresponding range data in the designated scene data set from among the plurality of setting data contained in the designated scene data set into the current data storage area.

2. A mixing system control method as claimed in claim 1 where said setting data modifying step is a step where a user specifies setting data to be included in the recall range by a selected one of first operation for designating setting data to be recalled and second operation for designating setting data to be not recalled.

3. A mixing system control method as claimed in claim 1 wherein the range data include validity data that indicates whether the range data themselves are valid or not, and wherein, in said scene storage step, all the setting data are stored in the scene storage area irrespective of whether or not the setting data are specified as the particular setting data by the range data, and wherein, in said scene recall step, when the validity data in the designated scene data set indicates that the range data are valid, the particular setting data specified from among the setting data in the designated scene data set are written into the current data storage area, and when the validity data in the designated scene data set indicates that the range data are not valid, all the setting data in the designated scene data set are written into the current data storage area irrespective of whether or not the setting data are specified as the particular setting data by the range data.

4. A computer program containing a group of instructions for causing a computer to perform the mixing system control method as recited in claim 1.

5. A mixing system control apparatus comprising:

a current data storage for storing a current data set the current data set including a plurality of setting data and range data that specifies, from among the plurality of setting data, particular setting data to be recalled;

a scene storage for storing a plurality of scene data sets, each of the scene data sets having a same data construction as the current data set;

a signal processing section that controls characteristics of a plurality of input signals and selectively mixes the input signals of the controlled characteristics in a plurality of different mixtures, on the basis of the setting data stored in the current data storage, so as to provide a plurality of mixed signals;

a setting data modifying section that modifies at least a portion of the setting data stored in the current data storage in response to detection of a modifying operation;

a range data setting section that sets the range data stored in the current data storage in response to detection of a recall range setting operation;

a scene storage control section that, in response to detection of a storing operation for a designated one of the scene data sets stored in the scene storage, stores the current data set, including said setting data and range data in the current data storage, to a storage location of the designated scene data in the scene storage; and a scene recall control section that, in response to detection of a recalling operation for a designated one of the scene data sets stored in the scene storage writes, the particular setting data specified by the corresponding range data in the designated scene data set from among the plurality of setting data contained in the designated scene data set into the current data storage.

6. A control method for a mixing system which includes a plurality of input ports for inputting respective ones of a plurality of signals and a plurality of input channels for executing an adjustment process based on operation of any one of operators provided in corresponding relation to the input channels, and wherein any one of the input ports is allocated to each of the input channels and each of the input channels receives a signal from the input port allocated to the input channel, and the signal received by the input channel is subjected to the adjustment process in the input channel and the signals having been subjected to the adjustment process are further subjected to a mixing process to provide mixed signals, said control method comprising:

a correspondency setting step of setting correspondency between the input channels and the input ports allocated thereto;

a port name assignment step of assigning a different port name to each of the input ports by designating a different string of characters for each of the input ports;

a name-assignment-mode setting step of designating one of a first name assignment mode and second name assignment mode for each of the input channels;

a first name assignment step of assigning a different channel name to each of the input channels in accordance with a string of characters designated for the input channel, on condition that said first name assignment mode is currently set for the input channel by said name-assignment-mode setting step;

a second name assignment step of assigning a channel name to each of the input channels on the basis of a port name of the input port allocated to the input channel, on condition that said second name assignment mode is currently set for the input channel by said name-assignment-mode setting step; and a display step of displaying the channel name, assigned to each of the input channels by said first name assignment step or said second name assignment step, in association with the operator provided for the input channel.

7. A control method for a mixing system which includes a plurality of input ports for inputting respective ones of a plurality of signals and a plurality of input channels for executing an adjustment process based on operation of any one of operators provided in corresponding relation to the input channels, and wherein any one of the input ports is allocated to each of the input channels and each of the input channels receives the signals from the input port allocated to the input channel, and the signal received by the input channel is subjected to the adjustment process in the input channel, and the signals having been subjected to the adjustment process are further subjected to a mixing process to provide mixed signals, said control method comprising:

a correspondency setting step of setting correspondency between the input channels and the input ports allocated thereto;

a port name assignment step of assigning a different port name to each of the input ports by designating a different string of characters for each of the input ports;

a channel name assignment step of assigning a different channel name to each of the input channels by designating a different string of characters for each of the input channels;

a determination step of determining, for each of the input channels, whether or not the channel name assigned to the input channel includes a predetermined code; and a display step of, for each of the input channels, displaying the channel name assigned to the input channel when it is determined that the channel name assigned to the input channel does not include the predetermined code and displaying the port name assigned to the input port allocated to the input channel when it is determined that the channel name assigned to the input channel does include the predetermined code, in association with the operator provided for the input channel.

8. A control method as claimed in claim 7 wherein, in said port name assignment step, the predetermined code can be entered only at a location of a first character of the channel name.

9. A computer program containing a group of instructions for causing a computer to perform the control method as recited in claim 6.

10. A computer program containing a group of instructions for causing a computer to perform the control method as recited in claim 7.

11. A control apparatus for a mixing system which includes a plurality of input ports for inputting respective ones of a plurality of signals and a plurality of input channels for executing an adjustment process based on operation of any one of operators provided in corresponding relation to the input channels, and wherein any one of the input ports is allocated to each of the input channels and each of the input channels receives a signal from the input port allocated to the input channel, and the signal received by the input channel is subjected to the adjustment process in the input channel and the signals having been subjected to the adjustment process are further subjected to a mixing process to provide mixed signals, said control apparatus comprising:

a correspondency setting section that sets correspondency between the input channels and the input ports allocated thereto;

a port name assignment section that assigns a different port name to each of the input ports by designating a different string of characters for each of the input ports;

a name-assignment-mode setting section that designates one of a first name assignment mode and second name assignment mode for each of the input channels;

a first name assignment section that assigns a different channel name to each of the input channels in accordance with a string of characters designated for the input channel, on condition that said first name assignment mode currently is set for the input channel by said name-assignment-mode setting section;

a second name assignment section that assigns a channel name to each of the input channels on the basis of a port name of the input port allocated to the input channel, on condition that said second name assignment mode is currently set for the input channel by said name-assignment-mode setting section; and a display section that displays the channel name, assigned to each of the input channels by said first name assignment section or said second name assignment section, in association with the operator provided for the input channel.

12. A control apparatus for a mixing system which includes a plurality of input ports for inputting respective ones of a plurality of signals and a plurality of input channels for executing an adjustment process based on operation of any one of operators provided in corresponding relation to the input channels, and wherein any one of the input ports is allocated to each of the input channels and each of the input channels receives the signals from the input port allocated to the input channel, and the signal received by the input channel is subjected to the adjustment process in the input channel, and the signals having been subjected to the adjustment process are further subjected to a mixing process to output mixed signals, said control apparatus comprising:

a correspondency setting section that sets correspondency between the input channels and the input ports allocated thereto;

a port name assignment section that assigns a different port name to each of the input ports by designating a different string of characters for each of the input ports;

a channel name assignment section that assigns a different channel name to each of the input channels by designating a different string of characters for each of the input channels;

a determination section that determines, for each of the input channels, whether or not the channel name assigned to the input channel includes a predetermined code; and a display section that, for each of the input channels, displaying the channel name assigned to the input channel when it is determined that the channel name assigned to the input channel does not include the predetermined code, and displays the port name assigned to the input port allocated to the input channel when it is determined that the channel name assigned to the input channel includes the predetermined code, in association with the operator provided for the input channel.

* * * * *